US006610636B2

(12) United States Patent
Berlowitz et al.

(10) Patent No.: US 6,610,636 B2
(45) Date of Patent: Aug. 26, 2003

(54) PREMIUM WEAR RESISTANT LUBRICANT

(75) Inventors: Paul J. Berlowitz, E. Windsor, NJ (US); Jacob J. Habeeb, Westfield, NJ (US); Robert J. Wittenbrink, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/035,874

(22) Filed: Nov. 9, 2001

(65) Prior Publication Data

US 2002/0086803 A1 Jul. 4, 2002

Related U.S. Application Data

(63) Continuation of application No. 09/712,653, filed on Nov. 14, 2000, now abandoned, which is a continuation of application No. 09/148,281, filed on Sep. 4, 1998, now Pat. No. 6,165,949.

(51) Int. Cl.[7] ..... C10M 141/10; C10M 141/12

(52) U.S. Cl. ..... 508/363; 508/368; 508/371; 508/562

(58) Field of Search ..... 508/363, 368, 508/371, 562

(56) References Cited

U.S. PATENT DOCUMENTS 4,943,672 A 7/1990 Hamner et al. ..... 585/253
4,990,713 A 2/1991 Le et al. ..... 585/332
5,059,299 A 10/1991 Cody et al. ..... 208/27
5,136,118 A 8/1992 Buchanan et al. ..... 585/255
5,246,566 A 9/1993 Miller ..... 208/27
5,726,133 A 3/1998 Blahey et al. ..... 508/390
5,882,505 A 3/1999 Wittenbrink et al. ..... 208/59
5,906,969 A 5/1999 Fyfe ..... 508/364

*Primary Examiner*—Jacqueline V. Howard
(74) *Attorney, Agent, or Firm*—Norby L. Foss

(57) ABSTRACT

A premium synthetic lubricant having antiwear properties comprises a synthetic isoparaffinic hydrocarbon base stock and an effective amount of at least one antiwear additive. The antiwear additive is preferably at least one of a metal phosphate, a metal dialkyldithiophosphate, a metal dithiophosphate a metal thiocarbamate, a metal dithiocarbamate, an ethoxylated amine dialkyldithiophosphate and an ethoxylated amine dithiobenzoate. Metal dialkyldithiophosphates are preferred, particularly zincdialkyldithiophosphate (ZDDP). The base stock is derived from a waxy, Fischer-Tropsch synthesized hydrocarbon feed fraction comprising hydrocarbons having an initial boiling point in the range of about 650–750° F., by a process which comprises hydroisomerizing the feed and dewaxing the isomerate. The lubricant may also contain hydrocarbonaceous and synthetic base stock material in admixture with the Fischer-Tropsch derived base stock.

27 Claims, No Drawings

PREMIUM WEAR RESISTANT LUBRICANT

This application is a continuation of U.S. Ser. No. 09/712,653 filed Nov. 14, 2000, now abandoned which is a continuation of U.S. Ser. No. 09/148,281 filed Sep. 4, 1998, now U.S. Pat. No. 6,156,949.

BACKGROUND OF THE DISCLOSURE

1. Field of the Invention

The invention relates to wear resistant lubricants using a premium synthetic base stock derived from waxy Fischer-Tropsch hydrocarbons, their preparation and use. More particularly the invention relates to a wear resistant lubricant, such as a lubricating oil, comprising an admixture of an effective amount of an antiwear additive and a synthetic base stock, wherein the base stock is prepared by hydroisomerizing waxy, Fischer-Tropsch synthesized hydrocarbons and, in the case of a wear resistant lubricating oil, dewaxing the hydroisomerate to reduce the pour point.

2. Background of the Invention

Internal combustion engine lubricating oils require the presence of antiwear additives in order to provide adequate antiwear protection for the engine. Increasing specifications for engine oil performance have exhibited a trend for increasing antiwear properties of the oil. While there are many different types of antiwear additives, for several decades the principal antiwear additive for internal combustion engine crankcase oils has been a metal alkylthiophosphate and more particularly a metal dialkyldithiophosphate in which the primary metal constituent is zinc, or zinc dialkyldithiophosphate (ZDDP). The ZDDP is typically used in amounts of from about 0.7 to 1.4 wt. % of the total lube oil composition. However, it has been found that the phosphorus from these additives has a deleterious effect on the catalyst in catalytic converters and also on oxygen sensors in automobiles. Furthermore, besides being expensive, some antiwear additives add to engine deposits, which causes increased oil consumption and an increase in particulate and regulated gaseous emissions. Therefore, reducing the amount of metal dialkyldithiophosphate such as ZDDP in the oil without compromising its wear performance would be desirable. One solution to this problem is to use expensive supplementary, phosphorus-free antiwear additives as set forth, for example, in U.S. Pat. No. 4,764,294. It would be an improvement to the art if the amount of antiwear additive, such as metal dialkyldithiophosphates or other expensive additives could be reduced without having to resort to the use of the supplementary additives, or if the amount of supplemental additives could be reduced without compromising engine protection. It would also be an improvement to the art if increased wear resistance could be achieved without having to substantially increase the amount of antiwear additives in the oil.

SUMMARY OF THE INVENTION

The invention relates to a wear resistant lubricant comprising an admixture of an effective amount of a lubricant antiwear additive and a lubricant base stock derived from waxy, Fischer-Tropsch synthesized hydrocarbons. The lubricant is obtained by adding to, blending or admixing the antiwear additive with the base stock. The amount of antiwear additive required to achieve a lubricant, such as a fully formulated lubricating oil, of a given level of wear resistance using a lubricant base stock derived from waxy, Fischer-Tropsch synthesized hydrocarbons is less than that required for a similar lubricating oil based on conventional petroleum oil or polyalphaolefin (PAO) oil base stocks. In a preferred embodiment the antiwear additive will comprise a metal dialkyldithiophosphate and preferably one in which the metal comprises zinc. Fully formulated lubricating oils such as motor oils, transmission oils, turbine oils and hydraulic oils all typically contain at least one, and more typically a plurality of additional additives not related to antiwear properties. These additional additives may include a detergent, a dispersant, an antioxidant, a pour point depressant, a VI improver, a friction modifier, a demulsifier, an antifoamant, a corrosion inhibitor, and a seal swell control additive. As a practical matter, a fully formulated lubricating oils of the type referred to above will typically contain at least one additional additive elected from the group consisting essentially of a detergent or dispersant, antioxidant, viscosity index (VI) improver and mixture thereof. Another embodiment of the invention resides in either reducing the amount of antiwear additive required for a given performance level in a fully formulated lubricating oil composition or increasing the wear resistance of a lubricant or fully formulated lubricating oil at a given level of antiwear additive, by using a base stock containing a sufficient amount of a base stock of the invention. Thus, while in many cases it will be advantageous to employ only a base stock derived from waxy Fischer-Tropsch hydrocarbons for a particular lubricant, in other cases one or more additional base stocks may be mixed with, added to or blended with one or more of the Fischer-Tropsch derived base stocks. Such additional base stocks may be selected from the group consisting of (i) a hydrocarbonaceous base stock, (ii) a synthetic base stock and mixture thereof. Because the Fischer-Tropsch base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the Fischer-Tropsch derived base stock will still provide superior properties in many most cases, although to a lesser degree than only if the Fischer-Tropsch derived base stock is used. Thus, the base stock of the invention will comprise all or a portion of the total base stock used in achieving the fully formulated lubricating oil. Hereinafter a fully formulated lubricating oil means one containing at least one antiwear additive and will also be referred to as a "lube oil".

Base stocks useful in the practice of the invention have been prepared by a process which comprises hydroisomerizing and dewaxing waxy, highly paraffinic, Fischer-Tropsch synthesized hydrocarbons boiling in the lubricating oil range, and preferably including waxy hydrocarbons boiling above the lubricating oil range. Base stocks useful in the practice of the invention have been produced by (i) hydroisomerizing waxy, FischerTropsch synthesized hydrocarbons having an initial boiling point in the range of 650–750° F. and an end point of at least 1050° F. (hereinafter "waxy feed") to form a hydroisomerate having an initial boiling point in said 650–750° F. range, (ii) dewaxing the 650–750° F.+ hydroisomerate to reduce its pour point and form a 650–750° F.+ dewaxate, and (iii) fractionating the 650–750° F.+ dewaxate to form two or more fractions of different viscosity as the base stocks. These base stocks are premium synthetic lubricating oil base stocks of high purity having a high VI, a low pour point and are isoparaffinic, in that they comprise at least 95 wt. % of non-cyclic isoparaffins having a molecular structure in which less than 25% of the total number of carbon atoms are present in the branches and less than half the branches have two or more carbon atoms. This base stock useful for making the wear resistant lubricants in the practice of the invention and those comprising PAO oil, differ from a base stock derived from petroleum oil or slack wax in an essentially nil heteroatom compound content and in comprising essentially non-cyclic isoparaffins. However, whereas a PAO base stock comprises essentially star-shaped molecules with long branches, the isoparaffins making up the base stock useful in the invention have mostly methyl branches. This is explained in detail below. Both the base stocks of the invention and fully formulated lubricating oils using them have exhibited properties superior to PAO and conventional mineral oil derived base stocks and corresponding formulated lubricating oils.

The waxy feed used to form the Fischer-Tropsch base stock preferably comprises waxy, highly paraffinic and pure Fischer-Tropsch synthesized hydrocarbons (sometimes referred to as Fischer-Tropsch wax) having an initial boiling point in the range of from 650–750° F. and continuously boiling up to an end point of at least 1050° F., and preferably above 1050° F. (1050° F.+). It is also preferred that these hydrocarbons have a $T_{90}$–$T_{10}$ temperature spread of at least 350° F. The temperature spread refers to the temperature difference in ° F. between the 90 wt. % and 10 wt. % boiling points of the waxy feed, and by waxy is meant including material which solidifies at standard conditions of room temperature and pressure. The hydroisomerization is achieved by reacting the waxy feed with hydrogen in the presence of a suitable hydroisomerization catalyst and preferably a dual function catalyst comprising at least one catalytic metal component to give the catalyst a hydrogenation/dehydrogenation function and an acidic metal oxide component to give the catalyst an acid hydroisomerization function. Preferably the hydroisomerization catalyst comprises a catalytic metal component comprising a Group VIB metal component, a Group VIII non-noble metal component and an amorphous alumina-silica component. The hydroisomerate is dewaxed to reduce the pour point of the oil, with the dewaxing achieved either catalytically or with the use of solvents, both of which are well known dewaxing processes. Catalytic dewaxing is achieved using any of the well known shape selective catalysts useful for catalytic dewaxing. Both hydroisomerization and catalytic dewaxing convert a portion of the 650–750° F.+ material to lower boiling (650–750° F.–) hydrocarbons. In the practice of the invention, it is preferred that a slurry Fischer-Tropsch hydrocarbon synthesis process be used for synthesizing the waxy feed and particularly one employing a Fischer-Tropsch catalyst comprising a catalytic cobalt component to provide a high alpha for producing the more desirable higher molecular weight paraffins. This process is also well known to those skilled in the art.

The waxy feed preferably comprises the entire 650–750° F.+ fraction formed by the hydrocarbon synthesis process, with the exact cut point between 650° F. and 750° F. being determined by the practitioner and the exact end point, preferably above 1050° F., determined by the catalyst and process variables used for the synthesis. The waxy feed also comprises more than 90%, typically more than 95% and preferably more than 98 wt. % paraffinic hydrocarbons, most of which are normal paraffins. It has negligible amounts of sulfur and nitrogen compounds (e.g., less than 1 wppm), with less than 2,000 wppm, preferably less than 1,000 wppm and more preferably less than 500 wppm of oxygen, in the form of oxygenates. Waxy feeds having these properties and useful in the process of the invention have been made using a slurry Fischer-Tropsch process with a catalyst having a catalytic cobalt component.

In contrast to the process disclosed in, for example, U.S. Pat. No. 4,963,672, the waxy feed need not be hydrotreated prior to the hydroisomerization and this is a preferred embodiment in the practice of process of the invention. Eliminating the need for hydrotreating the Fischer-Tropsch wax is accomplished by using the relatively pure waxy feed, and preferably in combination with a hydroisomerization catalyst resistant to poisoning and deactivation by oxygenates that may be present in the feed. This is discussed in detail below. After the waxy feed has been hydroisomerized, the hydroisomerate is typically sent to a fractionater to remove the 650–750° F.– boiling fraction and the remaining 650–750° F.+ hydroisomerate dewaxed to reduce its pour point and form a dewaxate comprising the desired lube oil base stock. If desired however, the entire hydroisomerate may be dewaxed. If catalytic dewaxing is used, that portion of the 650–750° F.+ material converted to lower boiling products is removed or separated from the 650–750° F.+ lube oil base stock by fractionation, and the 650–750° F.+ dewaxate fractionated separated into two or more fractions of different viscosity, which are the base stocks of the invention. Similarly, if the 650–750° F.– material is not removed from the hydroisomerate prior to dewaxing, it is separated and recovered during fractionation of the dewaxate into the base stocks.

DETAILED DESCRIPTION

A wear resistant lubricant of the invention, which includes both a grease and a fully formulated lubricating oil, is prepared by forming an admixture of an effective amount of at least on antiwear additive and an essentially isoparaffinic base stock comprising at least 95 wt. % of non-cyclic isoparaffins, explained in detail below. Illustrative, but non-limiting examples of antiwear additives useful in the practice of the invention include metal phosphates, preferably metal dithiophosphates and more preferably metal dialkyldithiophosphates, metal thiocarbamates, with metal dithiocarbamates preferred, and the ashless types including ethoxylated amine dialkyldithiophosphates and ethoxylated amine dithiobenzoates. Metals used comprise at least one metal selected from the group consisting of Group IB, IIB, VIB, VIIIB of the Periodic Table of the Elements and mixtures thereof, as shown in the Periodic Table of the Elements copyrighted in 1968 by the Sargent-Welch scientific Company. Hereinafter, all reference to Groups in the periodic table will refer to Groups as set forth in this reference. Nickel, copper, zinc and mixtures thereof are preferred metals. In the practice of the invention, the antiwear additive will preferably comprise a metal dithiophosphate, with a metal dialkyldithiophosphate being particularly preferred and with zinc being a particularly preferred metal. Thus, it is particularly preferred that zinc dialkyldithiophosphate comprise all or a portion of the phosphate antiwear additive in the practice of the invention. These compounds and the methods for making them are well known by those skilled in the art. The concentration of the metal phosphate in the finished lubricating oil composition of the invention will range from 0.1 to 3 wt. % and preferably 0.5 to 1.5 wt. % of the lubricant.

A fully formulated wear resistant lubricant of the invention is prepared by blending or admixing with the base stock an additive package containing an effective amount of at least one antiwear additive, along with additional additives such as at least one of a detergent, a dispersant, an antioxidant, a pour point depressant, a VI improver, a friction modifier, a demulsifier, an antifoamant, a corrosion inhibitor, and a seal swell control additive. Of these, in addition to the antiwear additives, those additives common to most formulated lubricating oils include a detergent, a dispersant, an antioxidant and a VI improver, with the others being optional depending on the intended use of the oil. An effective amount of at least one antiwear additive and typically one or more additives, or an additive package containing at least one antiwear additive and one or more such additives, is added to, blended into or admixed with the base stock to meet one or more specifications, such as those relating to a lube oil for an internal combustion engine crankcase, an automatic transmission, a turbine or jet, hydraulic oil, industrial oil, etc., as is known. Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. However, the chemical nature of the various additives is known to those skilled in the art. For example, alakli metal sulfonates and phenates are well known detergents, with PIBSA (polyisobutylene succinic anhydride) and PIBSA-PAM (polyisobutylene succinic anhydride amine) with or without being borated being well known and used dispersants. VI improvers and pour point depressants include acrylic polymers and copolymers such as polymethacrylates, polyalkylmethacrylates, as well as olefin copolymers, copolymers of vinyl acetate and ethylene, dialkyl fumarate and vinyl acetate, and others which are known. Friction modifiers include glycol esters and ether amines. Benzotriazole is a widely used corrosion inhibitor, while silicones are well known antifoamants. Antioxidants include hindered phenols and hindered aromatic amines such as 2,6-di-tert-butyl-4-n-butyl phenol and diphenyl amine, with copper compounds such as copper oleates and copper-PIBSA being well known. This is meant to be an illustrative, but nonlimiting list of the various additives used in lube oils. Thus, additive packages can and often do contain many different chemical types of additives and the performance of the base stock of the invention with a particular additive or additive package can not be predicted a priori. All of these additives are known and illustrative examples may be found, for example, in U.S. Pat. Nos. 5,352,374; 5,631,212; 4,764,294; 5,531,911 and 5,512,189. That its performance differs from that of conventional and PAO oils, with the same level of the same additives, is itself proof of the chemistry of the base stock of the invention being different from that of the prior art base stocks. As set forth above, in many cases it will be advantageous to employ only a base stock derived from waxy Fischer-Tropsch hydrocarbons for a particular wear resistant lubricant, while in other cases one or more additional base stocks may be mixed with, added to or blended with one or more of the Fischer-Tropsch derived base stocks. Such additional base stocks may be selected from the group consisting of (i) a hydrocarbonaceous base stock, (ii) a synthetic base stock and mixture thereof. By hydrocarbonaceous is meant a primarily hydrocarbon type base stock derived from a conventional mineral oil, shale oil, tar, coal liquefaction, or mineral oil derived slack wax, while a synthetic base stock will include a PAO, polyester types and other synthetics. Further, because the Fischer-Tropsch base stocks useful in the practice of the invention and antiwear lubricants based on these base stocks are different, and most often superior to, lubricants formed from other base stocks, it will be obvious to the practitioner that a blend of another base stock with at least 20, preferably at least 40 and more preferably at least 60 wt. % of the Fischer-Tropsch derived base stock will still provide superior properties in many most cases, although to a lesser degree than only if the Fischer-Tropsch derived base stock is used. Thus, in another embodiment, the invention relates to improving the wear resistance of a lube oil or other wear resistant lubricant, by forming the lubricant from a base stock which contains at least a portion of a Fischer-Tropsch derived base stock.

The composition of the Fischer-Tropsch derived base stock useful in the practice of the invention, and produced by a hydroisomerization and dewaxing process of the invention set forth above, is different from one derived from a conventional petroleum oil or slack wax, or a PAO. The base stock useful in the invention comprises essentially (≧99+ wt. %) all saturated, paraffinic and non-cyclic hydrocarbons. Sulfur, nitrogen and metals are present in amounts of less than 1 wppm and are not detectable by x-ray or Antek Nitrogen tests. While very small amounts of saturated and unsaturated ring structures may be present, they are not identifiable in the base stock by presently known analytical methods, because the concentrations are so small. While the base stock of the invention is a mixture of various molecular weight hydrocarbons, the residual normal paraffin content remaining after hydroisomerization and dewaxing will preferably be less than 5 wt. % and more preferably less than 1 wt. %, with at least 50% of the oil molecules containing at least one branch, at least half of which are methyl branches. At least half, and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules. PAO oils are a reaction product of alphaolefins, typically 1-decene and also comprise a mixture of molecules. However, whereas a PAO base stock comprises essentially star-shaped molecules with long branches, the isoparaffins making up the base stock of the invention have mostly methyl branches. PAO molecules have fewer and longer branches than the hydrocarbon molecules that make up the base stock of the invention. Thus, the molecular make up of a base stock of the invention comprises at least 95 wt. % isoparaffins having a relatively linear molecular structure, with less than half the branches having two or more carbon atoms and less than 25% of the total number of carbon atoms present in the branches.

During hydroisomerization of the waxy feed, conversion of the 650–750° F.+ fraction to material boiling below this range (lower boiling material, 650–750° F.–) will range from about 20–80 wt. %, preferably 30–70% and more preferably from about 30–60%, based on a once through pass of the feed through the reaction zone. The waxy feed will typically contain 650–750° F.– material prior to the hydroisomerization and at least a portion of this lower boiling material will also be converted into lower boiling components. Any olefins and oxygenates present in the feed are hydrogenated during the hydroisomerization. The temperature and pressure in the hydroisomerization reactor will typically range from 300–900° F. (149–482° C.) and 300–2500 psig, with preferred ranges of 550–750° F. (288–400° C.) and 300–1200 psig, respectively. Hydrogen treat rates may range from 500 to 5000 SCF/B, with a preferred range of 2000–4000 SCF/B. The hydroisomerization catalyst comprises one or more Group VIII catalytic metal components, and preferably non-noble catalytic metal component(s), and an acidic metal oxide component to give the catalyst both a hydrogenation/dehydrogenation function and an acid hydrocracking function for hydroisomerizing the hydrocarbons. The catalyst may also have one or more Group VIB metal oxide promoters and one or more Group IB metals as a hydrocracking suppressant. In a preferred embodiment the catalytically active metal comprises cobalt and molybdenum. In a more preferred embodiment the catalyst will also contain a copper component to reduce hydrogenolysis. The acidic oxide component or carrier may include, alumina, silica-alumina, silica-alumina-phosphates, titania, zirconia, vanadia, and other Group IL IV, V or VI oxides, as well as various molecular sieves, such as X, Y and Beta sieves. The elemental Groups referred to herein are those found in the Sargent-Welch Periodic Table of the Elements, © 1968. It is preferred that the acidic metal oxide component include silica-alumina and particularly amorphous silica-alumina in which the silica concentration in the bulk support (as opposed to surface silica) is less than about 50 wt. % and preferably less than 35 wt. %. A particularly preferred acidic oxide component comprises amorphous silica-alumina in which the silica content ranges from 10–30 wt. %. Additional components such as silica, clays and other materials as binders may also be used. The surface area of the catalyst is in the range of from about 180–400 $m^2/g$, preferably 230–350 $m^2/g$, with a respective pore volume, bulk density and side crushing strength in the ranges of 0.3 to 1.0 mL/g and preferably 0.35–0.75 mL/g; 0.5–1.0 g/mL, and 0.8–3.5 kg/mm. A particularly preferred hydroisomerization catalyst comprises cobalt, molybdenum and, optionally, copper, together with an amorphous silica-alumina component containing about 20–30 wt. % silica. The preparation of such catalysts is well known and documented. Illustrative, but non-limiting examples of the preparation and use of catalysts of this type may be found, for example, in U.S. Pat. Nos. 5,370,788 and 5,378,348. As was stated above, the hydroisomerization catalyst is most preferably one that is resistant to deactivation and to changes in its selectivity to isoparaffin formation. It has been found that the selectivity of many otherwise useful hydroisomerization catalysts will be changed and that the catalysts will also deactivate too quickly in the presence of sulfur and nitrogen compounds, and also oxygenates, even at the levels of these materials in the waxy feed. One such example comprises platinum or other noble metal on halogenated alumina, such as fluorided alumina, from which the fluorine is stripped by the presence of oxygenates in the waxy feed. A hydroisomerization catalyst that is particularly preferred in the practice of the invention comprises a composite of both cobalt and molybdenum catalytic components and an amorphous alumina-silica component, and most preferably one in which the cobalt component is deposited on the amorphous silica-alumina and calcined before the molybdenum component is added. This catalyst will contain from 10–20 wt. % $MoO_3$ and 2–5 wt. % CoO on an amorphous alumina-silica support component in which the silica content ranges from 10–30 wt. % and preferably 20–30 wt. % of this support component. This catalyst has been found to have good selectivity retention and resistance to deactivation by oxygenates, sulfur and nitrogen compounds found in the Fischer-Tropsch produced waxy feeds. The preparation of this catalyst is disclosed in U.S. Pat. Nos. 5,756,420 and 5,750,819, the disclosures of which are incorporated herein by reference. It is still further preferred that this catalyst also contain a Group IB metal component for reducing hydrogenolysis. The entire hydroisomerate formed by hydroisomerizing the waxy feed may be dewaxed, or the lower boiling, 650–750° F.– components may be removed by rough flashing or by fractionation prior to the dewaxing, so that only the 650–750° F.+ components are dewaxed. The choice is determined by the practitioner. The lower boiling components may be used for fuels.

The dewaxing step may be accomplished using either well known solvent or catalytic dewaxing processes and either the entire hydroisomerate or the 650–750° F.+ fraction may be dewaxed, depending on the intended use of the 650–750° F.– material present, if it has not been separated from the higher boiling material prior to the dewaxing. In solvent dewaxing, the hydroisomerate may be contacted with chilled ketone and other solvents such as acetone, MEK, MIBK and the like and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membranes or centrifugation. The solvent is then stripped out of the raffinate which is then fractionated to produce the base stocks of the invention. Catalytic dewaxing is also well known in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling, 650–750° F.– materials, which are separated from the heavier 650–750° F.+ base stock fraction and the base stock fraction fractionated into two or more base stocks. Separation of the lower boiling material may be accomplished either prior to or during fraction of the 650–750° F.+material into the desired base stocks.

The practice of the invention is not limited to the use of any particular dewaxing catalyst, but may be practiced with any dewaxing catalyst which will reduce the pour point of the hydroisomerate and preferably those which provide a reasonably large yield of lube oil base stock from the hydroisomerate. These include shape selective molecular sieves which, when combined with at least one catalytic metal component, have been demonstrated as useful for dewaxing petroleum oil fractions and slack wax and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective in the process of the invention comprises a noble metal, preferably Pt, composited with H-mordenite. The dewaxing may be accomplished with the catalyst in a fixed, fluid or slurry bed. Typical dewaxing conditions include a temperature in the range of from about 400–600° F., a pressure of 500–900 psig, $H_2$ treat rate of 1500–3500 SCF/B for flow-through reactors and LHSV of 0.1–10, preferably 0.2–2.0. The dewaxing is typically conducted to convert no more than 40 wt. % and preferably no more than 30 wt. % of the hydroisomerate having an initial boiling point in the range of 650–750° F. to material boiling below its initial boiling point.

In a Fischer-Tropsch hydrocarbon synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, Fischer-Tropsch hydrocarbon synthesis processes include processes in which the catalyst is in the form of a fixed bed, a fluidized bed and as a slurry of catalyst particles in a hydrocarbon slurry liquid. The stoichiometric mole ratio for a Fischer-Tropsch hydrocarbon synthesis reaction is 2.0, but there are many reasons for using other than a stoichiometric ratio as those skilled in the art know and a discussion of which is beyond the scope of the present invention. In a slurry hydrocarbon synthesis process the mole ratio of the $H_2$ to CO is typically about 2.1/1. The synthesis gas comprising a mixture of $H_2$ and CO is bubbled up into the bottom of the slurry and reacts in the presence of the particulate Fischer-Tropsch hydrocarbon synthesis catalyst in the slurry liquid at conditions effective to form hydrocarbons, at portion of which are liquid at the reaction conditions and which comprise the hydrocarbon slurry liquid. The synthesized hydrocarbon liquid is separated from the catalyst particles as filtrate by means such as simple filtration, although other separation means such as centrifugation can be used. Some of the synthesized hydrocarbons are vapor and pass out the top of the hydrocarbon synthesis reactor, along with unreacted synthesis gas and gaseous reaction products. Some of these overhead hydrocarbon vapors are typically condensed to liquid and combined with the hydrocarbon liquid filtrate. Thus, the initial boiling point of the filtrate will vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$–$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320–600° F., 80–600 psi and 100–40,000 V/hr/V, expressed as standard volumes of the gaseous CO and $H_2$ mixture (0° C., 1 atm) per hour per volume of catalyst, respectively. In the practice of the invention, it is preferred that the hydrocarbon synthesis reaction be conducted under conditions in which little or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable Fischer-Tropsch reaction types of catalyst comprise, for example, one or more Group VIII catalytic metals such as Fe, Ni, Co, Ru and Re, it is preferred in the process of the invention that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above under the SUMMARY, the waxy feed from which the base stock is derived comprises waxy, highly paraffinic and pure Fischer-Tropsch synthesized hydrocarbons (sometimes referred to as Fischer-Tropsch wax), preferably having an initial boiling point in the range of from 650–750° F. and preferably continuously boiling up to an end point of at least 1050° F. A narrower cut waxy feed may be used, but the base stock yield will be lower. During the hydroisomerization, a portion of the waxy feed is converted to lower boiling material. Hence, there must be sufficient heavy material to yield an isomerate boiling in the lube oil range. If catalytic dewaxing is used, some of the isomerate will also be converted to lower boiling material during the dewaxing. Hence, it is preferred that the end boiling point of the waxy feed be above 1050° F. (1050° F.+). Further, while narrow feed cuts may be used for special applications, the waxy feed will preferably have a $T_{90}$–$T_{10}$ temperature spread of at least 350° F. The temperature spread refers to the temperature difference in ° F. between the 90 wt. % and 10 wt. % boiling points of the waxy feed, and by waxy is meant including material which solidifies at standard conditions of room temperature and pressure. The temperature spread, while preferably being at least 350° F., is more preferably at least 400° F. and still more preferably at least 450° F. and may range between 350° F. to 700° F. or more. Waxy feed obtained from a slurry Fischer-Tropsch process employing a catalyst comprising a composite of a catalytic cobalt component and a titania component have been made having $T_{90}$–$T_{10}$ temperature spreads of as much as 490° F. and 600° F., having more than 10 wt. % of 1050° F.+ material and more than 15 wt. % of 1050° F.+ material, with respective initial and end boiling points of 500° F.–1245° F. and 350° F.–1220° F. Both of these samples continuously boiled over their entire boiling range. The lower boiling point of 350° F. was obtained by adding some of the condensed hydrocarbon overhead vapors from the reactor to the hydrocarbon liquid filtrate removed from the reactor. Both of these waxy feeds were suitable for use in the process of the invention, in that they contained material having an initial boiling point of from 650–750° F. which continuously boiled to an end point of above 1050° F., and a $T_{90}$–$T_{10}$ temperature spread of more than 350° F. Thus, both feeds comprised hydrocarbons having an initial boiling point of 650–750° F. and continuously boiled to an end point of more than 1050° F. These waxy feeds are very pure and contain negligible amounts of sulfur and nitrogen compounds. The sulfur and nitrogen contents are less than 1 wppm, with less than 500 wppm of oxygenates measured as oxygen, less than 3 wt. % olefins and less than 0.1 wt. % aromatics. The low oxygenate content of preferably less than 1,000 and more preferably less than 500 wppm results in less hydroisomerization catalyst deactivation.

The invention will be further understood with reference to the examples below, in which the $T_{90}$–$T_{10}$ temperature spread of the waxy feed was greater than 350° F.

EXAMPLES

Example 1

Fischer-Tropsch Wax Preparation

A Fischer-Tropsch synthesized waxy feed was formed in a slurry reactor from a synthesis gas feed comprising a mixture of $H_2$ and CO having an $H_2$ to CO mole ratio of between 2.11–2.16. The slurry comprised upflowing bubbles of the synthesis gas and particles of a Fischer-Tropsch hydrocarbon synthesis catalyst comprising cobalt and rhenium supported on titania dispersed in the hydrocarbon slurry liquid. The slurry liquid comprised hydrocarbon products of the synthesis reaction which were liquid at the reaction conditions. These included a temperature of 425° F., a pressure of 290 psig and a gas feed linear velocity of from 12 to 18 cm/sec. The alpha of the synthesis step was greater than 0.9. The waxy feed, which comprises the hydrocarbon products which are liquid at the reaction conditions and which comprises the slurry liquid, was withdrawn from the reactor by filtration. The boiling point distribution of the waxy feed is given in Table 1.

TABLE 1

| Wt. % Boiling Point Distribution of Synthesized Waxy Feed | |
|---|---|
| IBP–500° F. | 1.0 |
| 500–700° F. | 28.1 |
| 700° F.+ | 70.9 |
| 1050° F.+ | 6.8 |

Wax Hydroisomerization

The waxy feed produced in Example 1 was hydroisomerized without fractionation and therefore included the 29 wt. % of material boiling below 700° F. shown in Table 1. The waxy feed was hydroisomerized by reacting with hydrogen in the presence of a dual function hydroisomerization catalyst which consisted of cobalt (CoO, 3.2 wt. %) and molybdenum ($MoO_3$, 15.2 wt. %) on an amorphous silica-alumina cogel acidic support, 15.5 wt. % of which was silica. The catalyst had a surface area of 266 $m^2/g$ and a pore volume ($P.V._{H2O}$) of 0.64 mL/g. This catalyst was prepared by depositing and calcining the cobalt component on the support prior to the deposition and calcining of the molybdenum component. The conditions for the hydroisomerization are set forth in Table 2 and were selected for a target of 50 wt. % feed conversion of the 700° F.+ fraction which is defined as:

700° F.+ Conv.=[1−(wt. % 700° F.+ in product)/(wt. % 700° F.+ in feed)]×100

TABLE 2

| Hydroisomerization Reaction Conditions | |
|---|---|
| Temperature, ° F. (° C.) | 713 (378) |
| $H_2$ Pressure, psig (pure) | 725 |
| $H_2$ Treat Gas Rate, SCF/B | 2500 |
| LHSV, v/v/h | 1.1 |
| Target 700° F.+ Conversion, wt. % | 50 |

As shown in the Table, 50 wt. % of the 700° F.+ waxy feed was converted to 700° F.− boiling products. The 700° F.− hydroisomerate was fractionated to recover fuel products of reduced cloud point and freeze point.

Catalytic Dewaxing

The 700° F.+ hydroisomerate had a pour point of 2° C. and a VI of 148. This fraction was then catalytically dewaxed using a 0.5 wt. % Pt/H-mordenite catalyst to reduce the pour point and form a high VI lubricating base oil. The support consisted of a composite of 70 wt. % of the mordernite and 30 wt. % of an inert alumina binder. In this experiment, a small up-flow pilot plant unit was used. The dewaxing conditions included a 750 psig $H_2$ pressure, with a nominal treat gas rate of 2500 SCF/B at 1 LHSV and a temperature of 550° F. The dewaxate product exiting the reactor was fractionated using the standard 15/5 distillation to remove the lower boiling fuel components produced by the dewaxing and the 700° F.+ product subjected to Hivac distillation to obtain narrow cuts, which, for the sake of convennience, were blended back together to form a 700° F.+ base stock. The results are summarized in Table 3.

TABLE 3

| Dewaxed Oil Properties | |
|---|---|
| 700° F. + Base Stock (dewaxate) | |
| Yield, LV % on 700° F. Hydroisomerate | 76.4 |
| Pour Point, ° C. | −15 |
| KV at 40° C., cSt | 22.76 |
| KV at 100° C., cSt | 4.83 |
| VI | 138.1 |
| Noack, wt. % | 13 |
| CCS Viscosity at −20° C., cP | 810 |

Example 2

Wear tests were conducted on three different lubricating oil base stocks with no antiwear additive and on the same base stocks containing four different levels of the ZDDP antiwear additive. The tests were all conducted in a High Frequency Reciprocating Rig (HFFR) test (ISO Provisional Standard, TC22/SC7N595, 1995). This test is designed to predict wear performance of diesel fuels. A modified procedure was developed to evaluate the wear characteristics of the base stocks both with and without the ZDDP additive. Test conditions included a Time=200 minutes; Load=1 kg; Frequency=20 Hz, and a Temperature=120° C. In this test, the wear scar diameter of a loaded steel ball is the measure of the wear performance of the lubricant. All three base stocks, PAO, Solvent 150N (petroleum oil derived) and the dewaxed Fischer-Tropsch waxy feed hydroisomerate (FTDWI) had a kinematic viscosity of 5.2 cSt at 100° C. As shown in Table 4, without the ZDDP, the FTDWI exhibits a wear scar diameter similar to that of the S150N (454 mm and 449 mm), but significantly less than the PAO synthetic (633 mm). This indicates that less of the metal alkylthiophosphate antiwear additive will be required for a lubricating oil based on the FTDWI base stock, than for a lubricating oil containing the same additive but based on the PAO base stock. This is generally borne out by the data for all three base stocks to which the ZDDP was added as shown in Table 4.

TABLE 4

| | Wt. % of ZDDP Antiwear Additive | | | | |
|---|---|---|---|---|---|
| Base stock | None | 0.1 | 0.3 | 0.5 | 0.8 |
| S150N | 449 | 372 | 382 | 353 | 362 |
| PAO | 633 | 323 | 350 | 401 | 366 |
| FTDWI | 454 | 357 | 300 | 352 | 324 |

While the lubricating oils made from all three base stocks provided enhanced wear protection with the ZDDP, this Table shows that the wear protection provided by the lubricating oil made from the FTDWI containing 0.1 wt. %, 0.3 wt. %, 0.5 wt. % and 0.8 wt. % ZDDP was significantly greater than that provided the lubricating oils made from either the PAO or S150N base oils in the HFFR test. These results demonstrate that overall, the wear protection is better with the base stock of the invention. Concomitantly, a reduced amount of antiwear additive, such as a metal alkylthiophosphate antiwear additive, can be used in fully formulated lubricating oils based on the FTDWI compared to those based on the S150N or PAO, without using supplementary antiwear additives or compromising the required wear protection. Further, when the average results are listed, the improvement obtained using the FTDWI (the base stock of the invention) over the PAO or S150N is clear. These average results are shown in Table 5 below, along with average values for film coverage (larger is better) and average coefficient of friction values (lower is better).

TABLE 5

| Average Results With 0.1–0.8 Wt. % ZDDP | | | |
|---|---|---|---|
| Base Oil | Wear Scar | Friction | Film % |
| FTDWI | 341 | 0.089 | 95 |
| S150N | 376 | 0.097 | 93 |
| PAO | 360 | 0.098 | 87 |

While the invention has been demonstrated with a zinc alkyldithiophosphate antiwear additive, it is expected that the same or similar qualitative results of superior antiwear performance using the base stock of the invention will be achieved with other antiwear additives, such as and including those mentioned above. It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A method of improved resistance to wear comprising employing a wear resistant lubricant comprising an isoparaffinic base stock derived from waxy, paraffinic, Fischer-Tropsch synthesized hydrocarbons in admixture with an effective amount of at least one antiwear additive.

2. A method of improved resistance to wear according to claim 1 wherein said base stock comprises at least 95 wt. % non-cyclic isoparaffins.

3. A method of improved resistance to wear according to claim 2 wherein said antiwear additive is at least one of a metal phosphate, a metal dithiophosphate, a metal dialkyldithiophosphate, a metal thiocarbamate, a metal dithiocarbamate, an ethoxylated amine dialkyldithiophosphate and anethoxylated amine dithiobenzoate.

4. A method of improved resistance to wear according to claim 3 wherein said antiwear additive comprises a metal dialkyldithiophosphate.

5. A method of improved resistance to wear according to claim 4 wherein said metal comprises zinc.

6. A method of improved resistance to wear according to claim 3 further containing at least one of a detergent or dispersant, an antioxidant, an antiwear additive and a VI improver.

7. A method for improved resistance to wear according to claim 6 wherein said wear resistant lubricant is employed as a lubricant selected from the group consisting of a multigrade internal combustion engine crankcase oil, a transmission oil, a turbine oil and a hydraulic oil.

8. A method for improved resistance to wear according to claim 4 wherein said wear resistant lubricant is employed as a lubricant selected from the group consisting of a multigrade internal combustion engine crankcase oil, a transmission oil, a turbine oil and a hydraulic oil.

9. A method for improved resistance to wear according to claim 2 comprising said Fischer-Tropsch derived base stock and at least one other base stock selected from the group consisting of (i) a hydrocarbonaceous base stock, (ii) a synthetic base stock and mixture thereof.

10. A wear resistant lubricant according to claim 3 comprising said Fischer-Tropsch derived base stock and at least one other base stock selected from the group consisting of (i) a hydrocarbonaceous base stock, (ii) a synthetic base stock and mixture thereof.

11. A method of improved resistance to wear according to claim 8 comprising said Fischer-Tropsch derived base stock and at least one other base stock selected from the group consisting of (i) a hydrocarbonaceous base stock, (ii) a synthetic base stock and mixture thereof.

12. A method of improved resistance to wear comprising employing a lubricating oil comprising an isoparaffinic base stock derived from waxy, paraffinic, Fischer-Tropsch hydrocarbons and an effective amount of at least one antiwear additive, wherein said base stock comprises at least 95 wt. % non-cyclic isoparaffins having a molecular structure in which less than half the branches have two or more carbon atoms and with less than 25% of the total number of carbon atoms in the branches.

13. A method of improved resistance to wear according to claim 12 wherein at least half of the isoparaffin molecules contain at least one branch, at least half of which are methyl branches.

14. A method of improved resistance to wear according to claim 13 wherein at least half of the remaining, non-methyl branches on said isoparaffin molecules are ethyl, with less than 25% of the total number of branches having three or more carbon atoms.

15. A method of improved resistance to wear according to claim 14 wherein at least 75% of the non-methyl branches on said isoparaffinic base stock isoparaffin molecules are ethyl.

16. A method of improved resistance to wear according to claim 15 wherein the total number of branch carbon atoms on said isoparaffinic base stock molecules is from 10–15% of the total number of carbon atoms comprising said isoparaffin molecules.

17. A method of improved resistance to wear according to claim 12 wherein said base stock comprises said Fischer-Tropsch derived, isoparaffinic base stock in admixture with at least one base stock selected from the group consisting of (i) a hydrocarbonaceous base stock and (ii) a synthetic base stock.

18. A method of improved resistance to wear according to claim 16 wherein said base stock comprises said Fischer-Tropsch derived, isoparaffinic base stock in admixture with at least one base stock selected from the group consisting of (i) a hydrocarbonaceous base stock and (ii) a synthetic base stock.

19. A method of improved resistance to wear comprising an isoparaffinic base stock derived from a waxy, paraffinic hydrocarbon feed and an effective amount of at least one antiwear additive, wherein said base stock is produced by a process which comprises hydroisomerizing and dewaxing said waxy feed.

20. A method of improved resistance to wear according to claim 19 wherein said process comprises (i) hydroisomerizing said paraffinic, Fischer-Tropsch synthesized waxy hydrocarbon feed to form a hydroisomerate, (ii) dewaxing said hydroisomerate to reduce its pour point and form a 650–750° F.+ dewaxate, and (iii) fractionating said dewaxate to form two or more fractions of different viscosity, at least one of which comprises said base stock.

21. A method of improved resistance to wear according to claim 20 wherein said waxy feed has an initial boiling point in the range of 650–750° F. and an end point of at least 1050° F.

22. A method of improved resistance to wear according to claim 21 wherein (a) said waxy feed has a $T_{90}$–$T_{10}$ temperature spread of at least 350° F., (b) at least a portion of said hydroisomerate and said dewaxate have an initial boiling point in the 650–750° F. range.

23. A method of improved resistance to wear according to claim 22 wherein said waxy feed used in said process continuously boils over its boiling range, has an end boiling point above 1050° F. and comprises more than 95 wt. % normal paraffins.

24. A method of improved resistance to wear according to claim 21 wherein said hydroisomerization comprises reacting said waxy feed with hydrogen in the presence of a hydroisomerization catalyst having both a hydroisomerization function and a hydrogenation/dehydrogenation function and wherein said hydroisomerization catalyst comprises a catalytic metal component and an acidic metal oxide component.

25. A method of improved resistance to wear according to claim 24 wherein said waxy feed used in said process has less than 1 wppm of nitrogen compounds, less than 1 wppm of sulfur and less than 1,000 wppm of oxygen in the form of oxygenates.

26. A method of improved resistance to wear according to claim 23 wherein said base stock comprises said Fischer-Tropsch derived, isoparaffinic base stock in admixture with at least one of (i) a hydrocarbonaceous base stock and (ii) a synthetic base stock.

27. A method of improved resistance to wear according to claim 25 wherein said base stock comprises said Fischer-Tropsch derived, isoparaffinic base stock in admixture with at least one of (i) a hydrocarbonaceous base stock and (ii) a synthetic base stock.

* * * * *